United States Patent [19]

Bourdonne et al.

[11] Patent Number: 4,909,479

[45] Date of Patent: Mar. 20, 1990

[54] DEVICE FOR PRESTRESSING AN ASSEMBLY OF SCREWED CONNECTING MEMBERS

[75] Inventors: Jean-Claude Bourdonne, Le Breuil; Gérard Sevelinge, Montceau Les Mines, both of France

[73] Assignee: Framatome, Courbevoie, France

[21] Appl. No.: 281,712

[22] Filed: Dec. 9, 1988

[30] Foreign Application Priority Data

Dec. 9, 1987 [FR] France ..... 87 17154

[51] Int. Cl.[4] ..... E21B 19/00

[52] U.S. Cl. ..... 254/29 A

[58] Field of Search ..... 254/29 A; 81/57.38; 29/452

[56] References Cited

FOREIGN PATENT DOCUMENTS 1271050 6/1968 Fed. Rep. of Germany .
2902361 7/1980 Fed. Rep. of Germany .
2168632 4/1973 France .

*Primary Examiner*—Robert C. Watson
*Attorney, Agent, or Firm*—Pollock, Vande Sande & Priddy

[57] ABSTRACT

The device for prestressing an assembly of screwed connecting members, which consists of at least two bolts or pins intended for fastening a member (1) closing off an orifice (2) and which comprises a set of pulling jacks (26, 43) for the bolts or pins, comprises a body (10) consisting of two superposed solid elements (20, 40), each carrying half of the set of pulling jacks (26, 43), the pulling jacks (26, 43) in each of the superposed elements (20, 40) being arranged according to an alternate relative axial offset.

6 Claims, 2 Drawing Sheets

DEVICE FOR PRESTRESSING AN ASSEMBLY OF SCREWED CONNECTING MEMBERS

FIELD OF THE INVENTION

The present invention relates to a device for putting an assembly of screwed connecting members, such as bolts or pins, under prestress.

BACKGROUND OF THE INVENTION

In industrial installations using screwing elements, during the tightening and slackening operations, a pull is exerted on the said elements by means of a tension device, in order to keep them in a prestressed state.

This applies particularly to pressure vessels used, for example, in the nuclear or petrochemical industries in particular, where it is necessary to screw or unscrew several pins and also, by means of a single device, to exert a pull on all these pins, for example, the pins for fastening a flange or a plug to a passage hole for servicing work.

For this purpose, FR-A-No. 2,329,414 discloses a tension device composed of a set of hydraulic tensioners fastened and distributed in polar symmetry on a carrier ring. The hydraulic tensioners act simultaneously and achieve the desired prestress on each pin. To obtain the desired force, each hydraulic tensioner has several superposed stages, each comprising a piston equipped with a central bore, through which the pin shank passes.

However, because of the superposed active chambers, in this device the axial overall size is large. and production and assembly are complicated by the number of components to be machined, by the elements for the distribution of working fluid and also by the considerable number of sealing means.

FR-A-No. 2,274,997 discloses a device for screwing and unscrewing under tension in order to open or close the cover of a nuclear reactor vessel, comprising a carrier ring equipped with lifting jacks which, under pressure, subject the vessel pins to tension. This device uses a pair of single-stage jacks for each pin, thus considerably increasing the number of jacks on the carrier ring. Furthermore, the double thrust of the two jacks on each screwed element can cause force losses in relation to the axial direction, either as a result of tilting or as a result of the deformation of the screwed element.

Finally, FR-A-No. 2,564,767 discloses an apparatus for screwing and unscrewing a pin under tension, comprising a multiple-jack assembly, each of the jacks of which is associated with a screwed element. However, in this device, the symmetrical arrangement is in one and the same plane of the jacks, thus limiting the cross-section of the working chambers if it is necessary to have a higher force threshold, while maintaining an equivalent working-fluid pressure.

SUMMARY OF THE INVENTION

The object of the present invention is, therefore, to provide a device which is of simple design and which is easy to put into practice.

According to the invention, the device for prestressing an assembly of screwed connecting members, which consists of at least two bolts or pins intended for fastening a member of closing off an orifice and which has a set of pulling jacks for the said bolts or pins, comprises a body consisting of two superposed solid elements, each carrying half of the set of pulling jacks, the pulling jacks in each of the superposed elements being arranged according to an alternate relative axial offset.

According to another feature of the invention, the two superposed elements are independent and separable, the lower element comprising alternatively smooth through-holes and active chambers of the jacks, and the upper element comprising alternatively smooth through-holes and active chambers of the jacks.

BRIEF DESCRIPTION OF THE DRAWINGS

The invention will be better understood from the followind description, in which an embodiment of the invention is described by way of example and with reference to the accompanying drawings, in which.

DESCRIPTION OF PREFERRED EMBODIMENT

Figure 1:
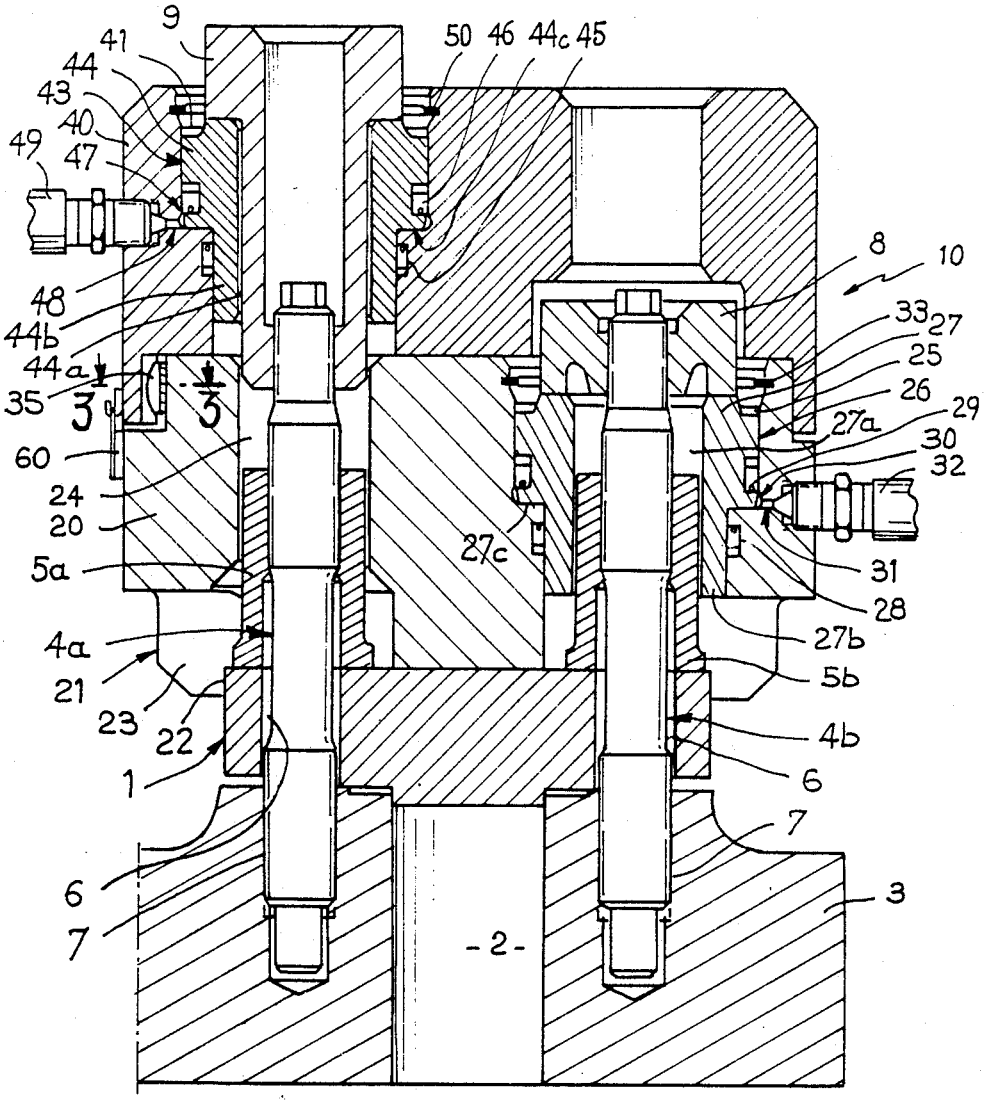
FIG. 1 is a front elevation of the prestressing device according to the invention in a cross-section along line 1—1 of FIG. 2.
Figure 2:
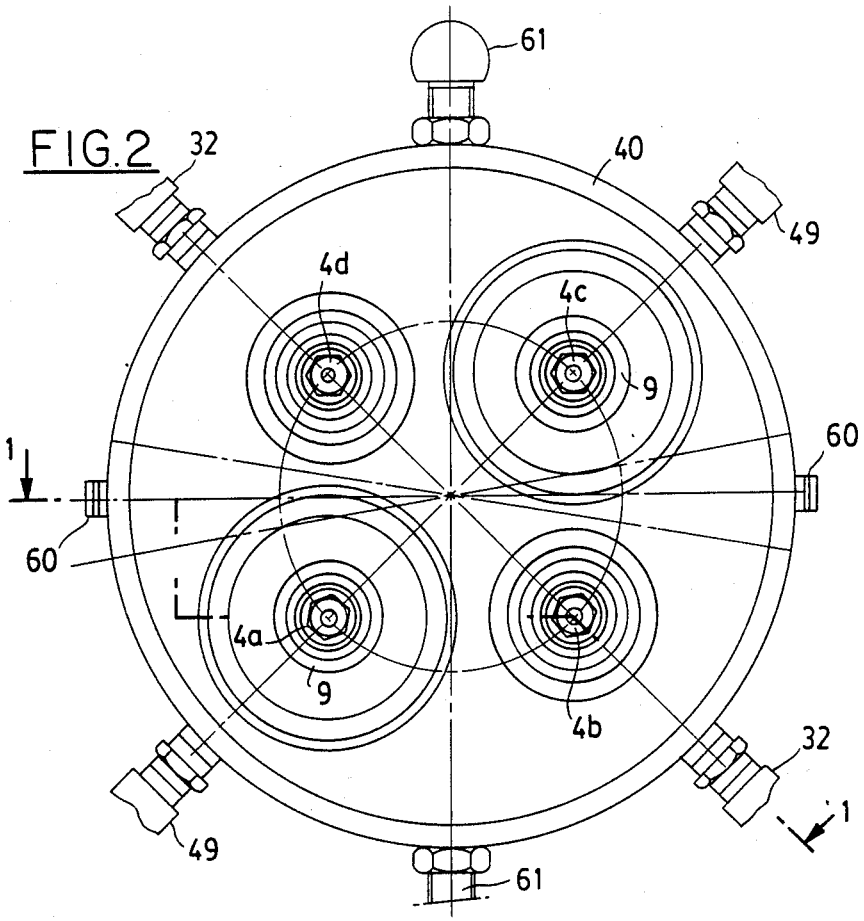
FIG. 2 is a plan view of FIG. 1.

The prestressing device according to the invention, as illustrated in FIGS. 1 and 2, is used to exert a pull on pins in order to keep them in the prestressed state, so as to make it possible to clamp or loosen, in this position, retaining nuts of a solid flange 1 or of a plug for closing off a passage hole 2 for servicing work in a pressurized vessel 3.

The solid flange 1 is fastened removably to the vessel 3 by means of several pins 4*a*, 4*b* . . . , with associated nuts 5*a*, 5*b*, . . . , the said pins being distributed uniformly on the periphery of the solid flange 1.

Each pin, passes through a smooth hole 6 made vertically in the flange 1 and, in its lower part, is provided with a thread intended to be screwed into an internally threaded hole 7 in the vessel 3. The other end of the pins, likewise has a thread for an engaging piece.

In the example illustrated, the device is intended for the tensioning of an assembly of four pins 4*a*, 4*b*, 4*c*, 4*d* holding the solid flange 1. However, it is clear that this device can be provided for a different number of pins.

The prestressing device according to the invention comprises a body designated as a whole by the reference 10 and consisting of two superposed solid disc-shaped elements 20 and 40.

The lower disc 20 is equipped, it its lower part, with a base 21 having an axial countersink 22, the bottom of which rests on the upper face of the flange 1, thus defining a reference face.

Machined in the base 21 are apertures 23 which are uniformly distributed circumferentially and which allow easy access to the nuts 5*a*, 5*b*, etc., in order to carry out the screwing and unscrewing operations at the moment of connection or disconnection.

The lower disc 20 is provided with one hand, smooth through-holes 24, through each of which pass the respective pins 4*a*, 4*c*, each equipped with a clamping nut 5*a*, 5*c*, alternating with active chambers 25, each containing a jack 26.

Each jack 26 consists of a piston 27 having a central bore 27*a*, through which passes the pin 4*b*, 4*d* equipped with its clamping nut 5*b*, 5*d*. The piston 27 is composed of a lower part forming a guide skirt 27*b* and of an upper part having an outside diameter larger than that of the guide skirt 27*b*.

The guide skirt 27*b* slides via a sealing means 28 seated in a groove in the lower disc 20, and a sealing means 29 is seated in a groove in the upper part of the piston 27. The shoulder 27c connecting the lower part and the upper part of the piston 27 corresponds to the active section of the jack, level with which there is, in the disc 20, a small annular chamber 30 located between the two sealing means 28 and 29. A duct 31, to which a pressurized-fluid injection nozzle 32 is connected, opens into the small annular chamber 30.

An upper stop 33 limiting the stroke of the piston 27 is accommodated in the active chamber 25 of the lower disc 20, above the said piston 27.

The upper face of the piston 27 is sequentially in contact with the lower face of a pull nut 8 screwed onto the upper threaded end part of the pin 4b, 4d. This nut may, for example, have an external shape which is either cylindrical and knurled or cylindrical with flats.

Figure 3:
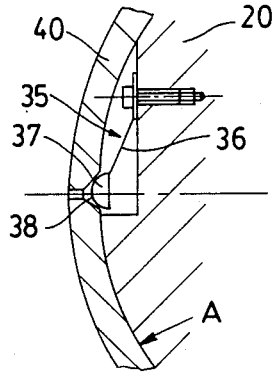
FIG. 3 is a detailed sectional view along the line 3—3 of FIG. 1.

The upper disc 40 is superposed concentrically on the lower disc 20 by means of the centering diameter A, and angular positioning is ensured by means of a member 35 also serving as a rotation-preventing means. This member 35 consists of an elastic finger 36 (FIG. 3), one end of which is fastened to the lower disc 20 and the other end of which has a small stud 37 interacting with a notch 38 formed in the upper disc 40, thus allowing only one angular position of the upper disc 40 in relation to the lower disc 20.

The upper disc 40 is provided with active chambers 41, each arranged above a smooth hole 24 in the lower disc, alternating with smooth through-holes 42 arranged above the active chambers 25 of the said lower disc.

As with the lower disc 20, the active chambers 41 of the upper disc 40 each contain a jack 43 consisting of a piston 44 having a central bore 44a, into the lower part of which penetrates the free end of the pin 4a, 4c. The piston 44 is identical to the piston 27, and is composed of a lower part forming a guide skirt 44b and of an upper part having an outside diameter larger than that of the guide skirt 44b.

The guide skirt 44b slides via a sealing means 45 seated in a groove made in the upper disc 40, and a sealing means 46 is seated in a groove made in the upper part of the piston 44. The shoulder 44c connecting the lower part and the upper part of the piston 44 corresponds to the active section of the jack, level with which there is, in the disc 40, a small annular chamber 47 located between the sealing means 45 and 46. A duct 48, to which a pressurized-fluid injection nozzle 49 is connected, opens into the small annular chamber 47.

An upper stop 50 limiting the stroke of the piston 44 is accommodated in the active chamber 41 of the upper disc 40, above the said piston 44.

The upper face of the piston 44 is sequentially in contact with the lower face of a pull nut 9 having a cylindrical extension which is directed towards the solid flange 1 and the end of which is screwed onto the upper end part of the pin 4a, 4c.

The pull nuts 8 and 9 all engage on the pins 4a, 4b, etc. to be prestressed over the same distance and at the same level, making it possible to have equivalent free lengths to be subjected to pulling.

Quick-gripping elements 60 arranged uniformly over the periphery of the discs 20 and 40 make it possible to fix the said discs to one another.

Handles 61 are provided on each of the discs 20 and 40, to make it easier to handle them.

The mode of operation of the device thus described is as follows.

First, the clamping nuts 5a, 5b, etc., screwed onto the pins 4a, 4b, etc., are brought in contact with the upper face of the flange 1. The complete lower disc 20, i.e., inclusive of the pistons 27, the sealing means 28 and 29 and the stop collars 33, is fitted on the flange 1 by means of the countersink 22. The pull nuts 8 are placed on the pins 4b and 4d and screwed so as to come into contact with the corresponding piston 27. Subsequently, the upper disc 40 is placed on the lower disc 20, the member 35 ensuring the angular positioning of the upper disc 40 on the lower disc 20.

The pull nuts are screwed onto the pins 4a and 4c so as to come into contact with the corresponding piston 44. The quick-gripping members 60 fix the assembly together.

The nozzles 32 and 49 connected to an accessory control and pressurized-fluid supply device are fitted to the ducts 31 and 48.

The series of jacks 26 and 43 is supplied with working fluid simultaneously, and under the effect of the pressure in the chambers 30 and 47 the pistons 27 and 44 move axially, thus driving the pull nuts 8 and 9. The pulling force so generated subjects the pins 4a, 4b, etc., to an elongation corresponding to the desired prestress. The lower face of the nuts 5a, 5b, etc., is consequently moved away from the flange to be clamped, thus delimiting a space. The nuts 5a, 5b, etc., are subsequently connected by screwing, independently or simultaneously, by means of a specific tool entering the gaps 23 and are once again brought into light contact with the face of the flange 1 to be clamped.

After the pressure in the jacks 26 and 43 has been relaxed, the force laying the pistons 27 and 44 against the nuts 8 and 9 becomes zero. Without any special effort, the nuts 9 and the upper disc 40 are removed. The same operation to remove the nuts 8 is carried out, thus freeing the lower disc from the flange 1.

To slacken the pins 4a, 4b, etc., the operation is carried out in reverse.

This device, which is of simple design and is easy to put into practice, has many advantages.

First of all, it makes it possible to maintain a working fluid pressure within the range of the customary uses, in order to obtain tension forces for pins which are distributed over a wide range, despite the use of single-chamber jacks, and it consists of a set of only a few interchangeable components having standard machining and with a number of bearing surfaces for sealing means which is reduced to a minimum.

Another advantage of this device is that it is composed of two solid and very rigid superposed components forming the body and each carrying half the total number of jacks, and that it is easy to handle because of its modular design.

Furthermore, the device is maintained easily and quickly and is assembled in a simple and efficient way requiring no special tool, while at the same time allowing access to the sealing means which is made easier by their arrangement, either for inspection purposes or for interchangeability.

The device according to the invention applies particularly to vessels and enclosures under pressure, manholes, inspection holes, turbines and hydraulic valves, for fastening a closure in plants such as nuclear, petrochemical or chemical plants and also in the motor and aeronautic industries. In general, the device applies to many industrial plants employing screwing coupling members.

We claim:

1. Device for prestressing an assembly of screwed connecting members consisting of at least two bolts (4*a*, 4*b* . . . ) for fastening a member (1) for closing off an orifice (2), said device comprising a set of pulling jacks (26, 43) for said bolts, a body (10) consisting of two superposed lower and upper solid elements (20, 40), each carrying half of said set of pulling jacks (26, 43), said pulling jacks in each of said superposed elements (20, 40) being arranged according to an alternate relative axial offset.

2. Device according to claim 1, wherein said two superposed elements (20, 40) are independent and separable, said lower element (20) having alternatively smooth through-holes (24) and active chambers (25) of said jacks (26) and said upper element (40) having alternately smooth through-holes (42) and active chambers (41) of said jacks (43).

3. Device according to claim 2, wherein said smooth through-holes (42) of said upper element (40) are arranged above said active chambers (25) of said lower element (20), and said active chambers (41) of said upper element (40) are arranged above said smooth through-holes (24) of said lower element (20).

4. Device according to claim 1, wherein tensioning of said screwed connecting members by means of said jacks (26, 43) of said lower and upper elements (20, 40) takes place over a same distance and at a same level, in order to provide equivalent free lengths to be tensioned.

5. Device according to claim 1, wherein said upper and lower elements (20, 40) are centered and keyed in terms of rotation relative to one another by means of a rotation-preventing positioning member (35).

6. Device according to claim 5, wherein said rotation-preventing positioning member (35) consists of an elastic finger (36), one end of which is fastened to said lower element (20) and the other end of which has a small stud (37) interacting with a notch (38) formed in said upper element (40).

* * * * *